US012024869B2

(12) United States Patent
Zhang et al.

(10) Patent No.: US 12,024,869 B2
(45) Date of Patent: Jul. 2, 2024

(54) AIR RELEASE VALVE AND AIR PRESSURE DRIVEN TOILET WATER TANK DRAIN VALVE

(71) Applicant: LAB (XIAMEN) SANITARY FITTINGS INC, Fujian (CN)

(72) Inventors: Zipeng Zhang, Fujian (CN); Yongmao Liu, Fujian (CN)

(73) Assignee: LAB (XIAMEN) SANITARY FITTINGS INC, Fujian (CN)

( * ) Notice: Subject to any disclaimer, the term of this patent is extended or adjusted under 35 U.S.C. 154(b) by 72 days.

(21) Appl. No.: 17/920,059

(22) PCT Filed: Apr. 20, 2020

(86) PCT No.: PCT/CN2020/085517

§ 371 (c)(1),
(2) Date: Oct. 20, 2022

(87) PCT Pub. No.: WO2021/212252

PCT Pub. Date: Oct. 28, 2021

(65) Prior Publication Data

US 2023/0160190 A1 May 25, 2023

(51) Int. Cl.
*E03D 1/30* (2006.01)
*E03D 1/34* (2006.01)

(52) U.S. Cl.
CPC ..... *E03D 1/302* (2013.01); *E03D 1/34* (2013.01)

(58) Field of Classification Search
CPC ..... E03D 1/302; E03D 1/34; E03D 1/142; E03D 1/35; E03D 5/024; E03D 5/105
See application file for complete search history.

(56) References Cited

FOREIGN PATENT DOCUMENTS

| | | | |
|---|---|---|---|
| CN | 205776606 | U | 12/2016 |
| CN | 207486178 | U | 6/2018 |
| CN | 208685732 | U | 4/2019 |
| CN | 208816695 | U | 5/2019 |
| EP | 0801179 | A2 | 10/1997 |
| EP | 2775048 | A1 | 9/2014 |

*Primary Examiner* — Christine J Skubinna
(74) *Attorney, Agent, or Firm* — Cooper Legal Group, LLC

(57) ABSTRACT

An air release valve and an air pressure driven toilet water tank drain valve are provided. The air release valve includes a valve seat, a sliding block, and a push block. A bottom of the valve seat is provided with an air release channel, one end of the air release channel is an air inlet, and the other end of the air release channel forms an air release nozzle. The sliding block is located above the air release nozzle and is slidably arranged on the valve seat. The air pressure driven toilet water tank drain valve includes a drain valve body, an inner core tube, a limit device, a telescopic airbag, an air pump, the air release valve, a controller and an electronic induction switch. The air release valve with mechanical structure does not require power consumption and has low cost.

7 Claims, 9 Drawing Sheets

AIR RELEASE VALVE AND AIR PRESSURE DRIVEN TOILET WATER TANK DRAIN VALVE

TECHNICAL FIELD

The disclosure relates to a toilet water tank drain valve opened by air pressure, in particular to an air pressure driven toilet water tank drain valve and an air release valve thereof.

BACKGROUND

The traditional toilet water tank drain valve pushes the swing rod by pressing the button. The swing rod lifts the inner core tube of the drain valve and fits the hook of the half drainage limit device or the full drainage limit device. The water sealing piece at the lower end of the inner core tube separates from the water outlet of the valve body to open the half drainage limit or the full drainage limit function of the drain valve. When the water level of the water tank falls, the half drainage floating bucket of the half drainage limit device or the full drainage floating bucket of the full drainage limit device loses buoyancy, the inner core tube loses the hook support of the half drainage limit device or the full drainage limit device, the inner core tube is released from the hook and fall, the water sealing piece at the lower end of the inner core tube and the water outlet of the valve body are resealed, and the drainage is closed.

It can be seen from the above that the button, swing rod and inner core tube of the traditional toilet water tank drain valve are a mechanical lever transmission structure, which requires people to manually press the button to achieve the lifting of the inner core tube. Now the country advocates people to pursue a high-quality and beautiful life, and people hope to open the toilet water tank drain valve through electronic induction, instead of pressing the drain valve button installed on the toilet water tank, which is convenience, saves effort, and also avoids cross infection caused by different people pressing the drain valve button.

At present, there are air pressure driven toilet water tank drain valves on the market, which are electrically connected with the air pump through the electronic inductive switch and controller, and the air pump is connected with the telescopic airbag through the air pipe. The air pipe is connected with an electromagnetic pressure relief valve. When drainage is needed, people wave their hands above the electronic inductive switch, and the electronic inductive switch sends the inductive signal to the controller. The controller turns on the air pump, and the air pump inflates the telescopic airbag. The telescopic airbag expands and pushes the lifting cover on the inner core tube of the drain valve to drive the inner core tube to rise. When the inner core tube rises to clamp the hook of the half drainage limit device or the full drainage limit device of the drain valve, the electromagnetic pressure relief valve opens, and the air in the telescopic airbag is released through the electromagnetic pressure relief valve. The telescopic airbag uses its own elastic retraction to restore the original state, giving way to the falling of the inner core tube, the water sealing piece at the lower end of the inner core tube separates from the water outlet of the valve body, and the half drainage or full drainage function of the drain valve is enabled. When the water level of the water tank falls, and the half drainage floating bucket of the half drainage limit device or the full drainage floating bucket of the full drainage limit device loses buoyancy, the inner core tube loses the hook support of the half drainage limit device or the full drainage limit device, and the inner core tube falls after the clamp relationship between the inner core tube and the hook is relieved. Before the inner core tube falls, the water sealing piece at the lower end of the inner core tube and the water outlet of the valve body are resealed, such that the drainage is closed.

It can be seen from the above that the telescopic airbag needs to be depressurized through the electromagnetic pressure relief valve. Once the electromagnetic pressure relief valve is damaged and fails, the telescopic airbag can not be inflated or deflated, resulting in the abnormal use of the drain valve. In addition, the electromagnetic pressure relief valve has the disadvantages of high cost and power consumption. The inventor has developed an air release valve that uses a mechanical structure to realize the pressure relief of the telescopic airbag.

SUMMARY

The disclosure provides an air release valve of a toilet water tank drain valve opened by air pressure. The air release valve has reliable performance, low cost and no power consumption.

The disclosure also provides an air pressure driven toilet water tank drain valve, which has simple opening mode, reliable performance and low cost.

The technical solution to achieve the above object is shown as follows:

An air release valve, including a valve seat, a sliding block and a push block, wherein the valve seat is arranged at an upper part of the drain valve body through a mounting seat, a bottom of the valve seat is provided with an air release channel, one end of the air release channel is an air inlet, the other end of the air release channel forms an air release nozzle, the sliding block is located above the air release nozzle and is slidably arranged on the valve seat, and a bottom of the sliding block is provided with a sealing gasket for sealing the air release nozzle, a compressed elastic element is arranged between a side of the sliding block away from an inner core tube of the drain valve and the valve seat, a limit bump is arranged at a side of the sliding block close to the inner core tube of the drain valve, a limit stopper for clamping the limit bump is arranged at the valve seat, an upper stopper and a lower stopper are arranged at the side of the sliding block close to the inner core tube of the drain valve, a lower part of the upper stopper is an inclined plane, and the push block is arranged between the upper stopper and the lower stopper and is arranged at an upper part of the inner core tube of the drain valve.

A cylindrical cavity is formed on the valve seat, the air release channel is arranged at a bottom of the cylindrical cavity, the air inlet is communicated to an outer side of the bottom of the cylindrical cavity, and the air release nozzle is communicated to an inside of the cylindrical cavity; the sliding block comprises a column rod and a press rod, the column rod and an upper part of the press rod are integrally formed, the column rod is slidably arranged in the cylindrical cavity, and the sealing gasket is arranged at a bottom of the column rod; the compressed elastic element is arranged on an upper part of the column rod and located between a side far away from the inner core tube of the drain valve and the cylindrical cavity; the limit bump is arranged on a side of the column rod close to the inner core tube of the drain valve, the limit stopper is a limit hole, and the limit hole is correspondingly arranged on a side wall of the cylindrical cavity; the press rod is arranged outside the cylindrical cavity and near the side of the inner core tube of the drain valve, and the upper stopper and the lower stopper are respectively arranged on an upper and a bottom of the press rod.

The elastic element is a spring, the upper part of the column rod is provided with a transverse blind hole, the spring is placed in the transverse blind hole, and one end of the spring extends out of the transverse blind hole and butts against the side wall of the cylindrical cavity of the valve seat.

An air pressure driven toilet water tank drain valve, including a drain valve body, an inner core tube, a limit device, a telescopic airbag, an air pump, the air release valve, a controller, and an electronic inductive switch, wherein the air pump and the electronic inductive switch are electrically connected with the controller; the limit device comprises a half drainage limit device and a full drainage limit device, the half drainage limit device and the full drainage limit device are arranged in the drain valve body, the inner core tube passes through the drain valve body, a middle of the inner core tube is clamped with the half drainage limit device and the full drainage limit device respectively; a bottom of the inner core tube is provided with a water sealing piece to block the water outlet at a bottom of the drain valve body; an upper part of the inner core tube extends out of the drain valve body and is provided with a lifting cover, the lifting cover comprises a half drainage lifting cover and a full drainage lifting cover, and the half drainage lifting cover and the full drainage lifting cover are symmetrically arranged on a left side and a right side of an upper end of the inner core tube; the left and right telescopic airbags are respectively located under the half drainage lifting cover and the full drainage lifting cover and fixed on the drain valve body; the left telescopic airbag for the half drainage is connected with a half drainage air pipe of the air pump through an air pipe, and the right telescopic airbag for the full drainage is connected with a full drainage air pipe of the air pump, the valve seats of the left and the right air release valves are set on the mounting seat at the same time, separated from each other and arranged in a mirror setting with the inner core tube as an axis; the upper stopper and the lower stopper of the left and right air release valves are opposite arranged; the push block of the air release valve is divided into a left push part and a right push part on the inner core tube of the drain valve, the left push part is higher than the right push part, the left push part is located between the upper stopper and the lower stopper of the left air release valve, and the right push part is located between the upper stopper and the lower stopper of the right air release valve; the air inlet of the air release valve for the left half drainage is connected with the air pipe of the left telescopic airbag for the half drainage and the half drainage air pipe of the air pump, and the air inlet of the air release valve for the right full drainage is connected with the air pipe of the right telescopic airbag for the full drainage and the full drainage air pipe of the air pump.

The half drainage limit device in the drain valve body is higher than the full drainage limit device, the half drainage limit device comprises a half drainage floating bucket, a half drainage rotating frame and a half drainage hook, the half drainage rotating frame is rotatably fixed in the drain valve body, the half drainage floating bucket is rotatably arranged on one side of the half drainage rotating frame, and the other side of the half drainage rotating frame is provided with the half drainage hook; the full drainage limit device comprises a full drainage floating bucket, a full drainage rotating frame and a full drainage hook, the full drainage rotating frame is rotatably fixed in the drain valve body, the full drainage floating bucket is rotatably arranged on one side of the full drainage rotating frame, and the other side of the full drainage rotating frame is provided with the full drainage hook; the inner core tube passes through central holes of the half drainage rotating frame and the full drainage rotating frame respectively; the half drainage hook is clamped with a half drainage clamping point in the middle of the inner core tube, and the full drainage hook is clamped with a full drainage clamping point in the middle of the inner core tube.

The telescopic airbag is arranged in a cylinder body, the cylinder body is located below the lifting cover of the inner core tube and is placed on the drain valve body, the cylinder body is slidably provided with a piston push rod, a lower end of the piston push rod is connected with the telescopic airbag, and an upper end of the piston push rod extends out of the cylinder body to push the lifting cover of the inner core tube.

The working principle of the air release valve of the disclosure is as follows: When the drain valve is to stop drainage, the inner core tube falls to drive the water sealing piece to seal the water outlet of the drain valve, the lower stopper is pressed by the push block, the elastic element pushes the limit bump of the sliding block to insert into the limit stopper on the valve seat, and the sealing gasket at the bottom of the sliding block blocks the air release nozzle, thus sealing the air release nozzle. When the drain valve is opened for drainage, the inner core tube rises, the water sealing piece separates from the water outlet of the drain valve. When the inner core tube rises to clamp the limit device of the drain valve, the inclined plane of the lower part of the upper stopper is pushed upward by the push block, the elastic element is compressed, the sliding block laterally shifts on the valve seat, the limit bump of the sliding block exits the limit stopper on the valve seat, and the sealing gasket at the bottom of the sliding block separates from the air release nozzle, so as to open the air release nozzle for air release.

The working principle of the toilet water tank drain valve opened by the air pressure of the disclosure is that when the drain valve needs to be opened for drainage, people wave their hands above the electronic induction switch, the electronic induction switch sends an induction signal to the controller, the controller turns on the air pump, the air pump inflates the telescopic airbag, the telescopic airbag expands and pushes the lifting cover on the inner core tube of the drain valve, so as to drive the inner core tube to rise, and the water sealing piece separates from the water outlet of the drain valve, so as to open the half drainage or full drainage function of the drain valve. When the inner core tube rises to clamp the hook of the half drainage limit device or the full drainage limit device, the push block pushes against the inclined plane of the lower part of the upper stopper. The elastic element is compressed, the sliding block moves laterally on the valve seat, the limit bump of the sliding block exits the limit stopper on the valve seat, and the sealing gasket at the bottom of the sliding block separates from the air release nozzle, so as to open the air release nozzle for air release. The telescopic airbag uses its own elastic retraction to restore the original state, giving way to the falling of the inner core tube. After the drainage is completed, when the inner core tube falls and drives the water sealing piece to reseal the water outlet of the drain valve, the lower stopper is pressed by the push block, the elastic element pushes against the limit bump of the sliding block to insert into the limit stopper on the valve seat, the sealing gasket at the bottom of the sliding block blocks the air release nozzle, so as to seal the air release nozzle, and a closed air path is formed between the air pump and the telescopic airbag to prepare for the next drainage opening.

Compared with the existing air pressure driven toilet water tank drain valve, the disclosure uses the mechanical structure of the air release valve and removes the electromagnetic pressure relief valve, though the rising and falling motion of the inner core tube itself to push the sliding block of the air release valve up and down, and uses the expansion and contraction of the compressed elastic element to make the sliding block move laterally, so that the limit bump of the sliding block can insert or exit the limit stopper on the valve seat. Thus, the sealing gasket at the bottom of the sliding block can be opened or blocked the air release nozzle. The air release valve of the disclosure uses mechanical movement to open and close, without power consumption, has simple structure, reliable performance and low cost, and is more suitable for opening the drain valve of the toilet water tank by air pressure.

BRIEF DESCRIPTION OF THE DRAWINGS

The embodiments of the disclosure are further described in detail below in combination with the accompanying drawings.

DETAILED DESCRIPTION OF THE EMBODIMENTS

The disclosure is described in detail below in combination with the drawings and embodiments.

Figure 1:
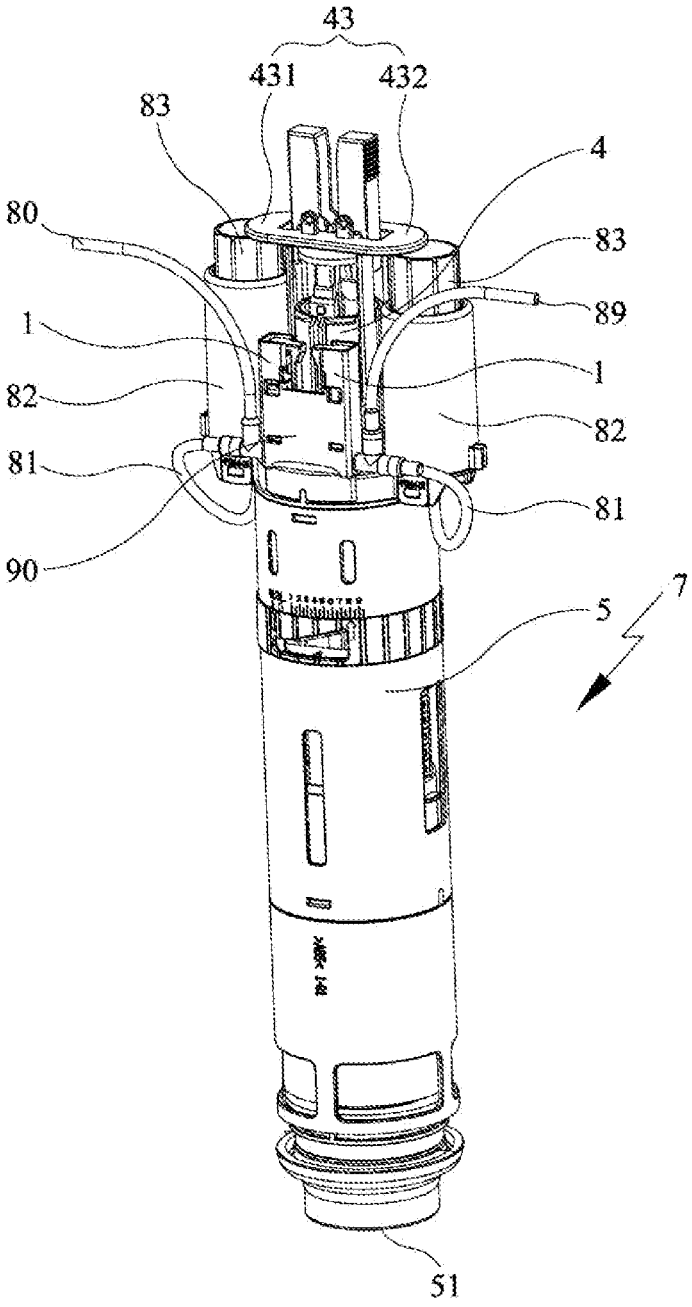
FIG. 1 is a perspective view of the air release valve of the disclosure assembled on the air pressure driven toilet water tank drain valve.
Figure 2:
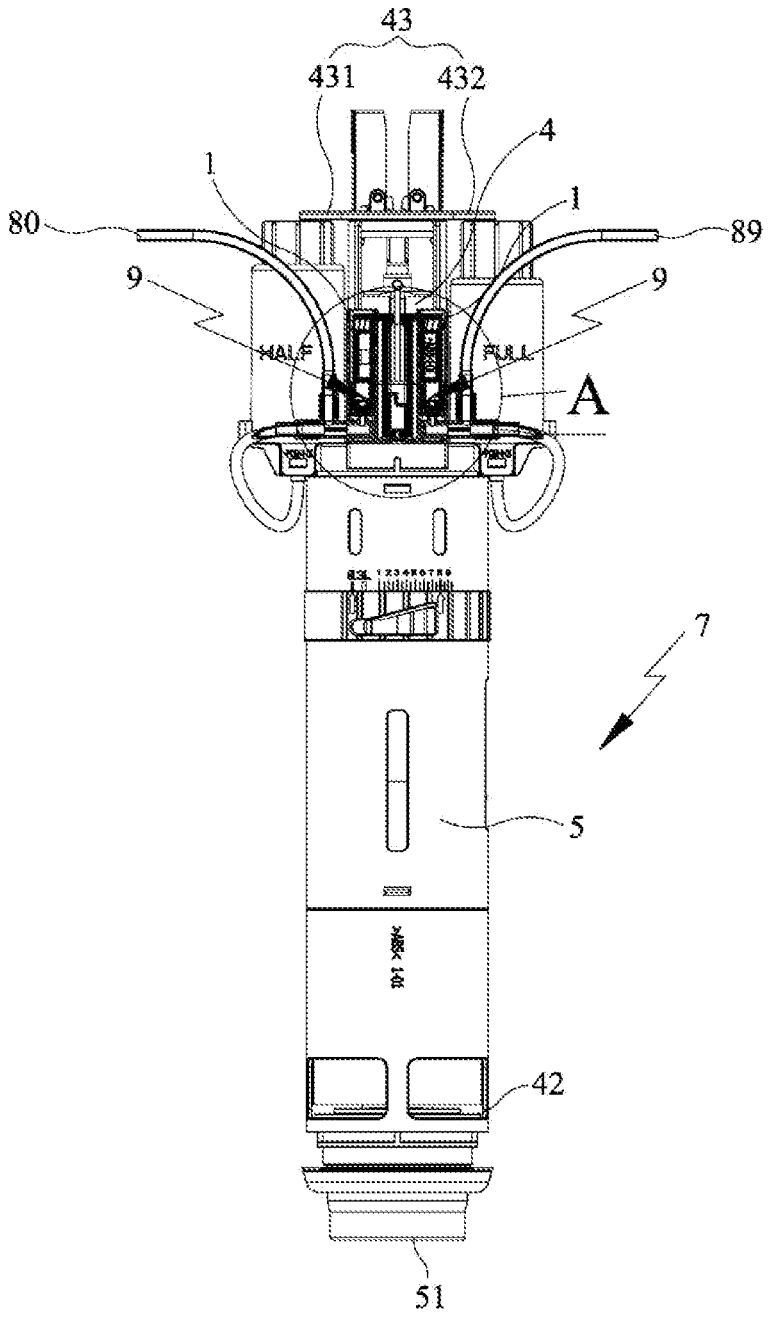
FIG. 2 is a sectional view of the air release valve of the disclosure.
Figure 3:
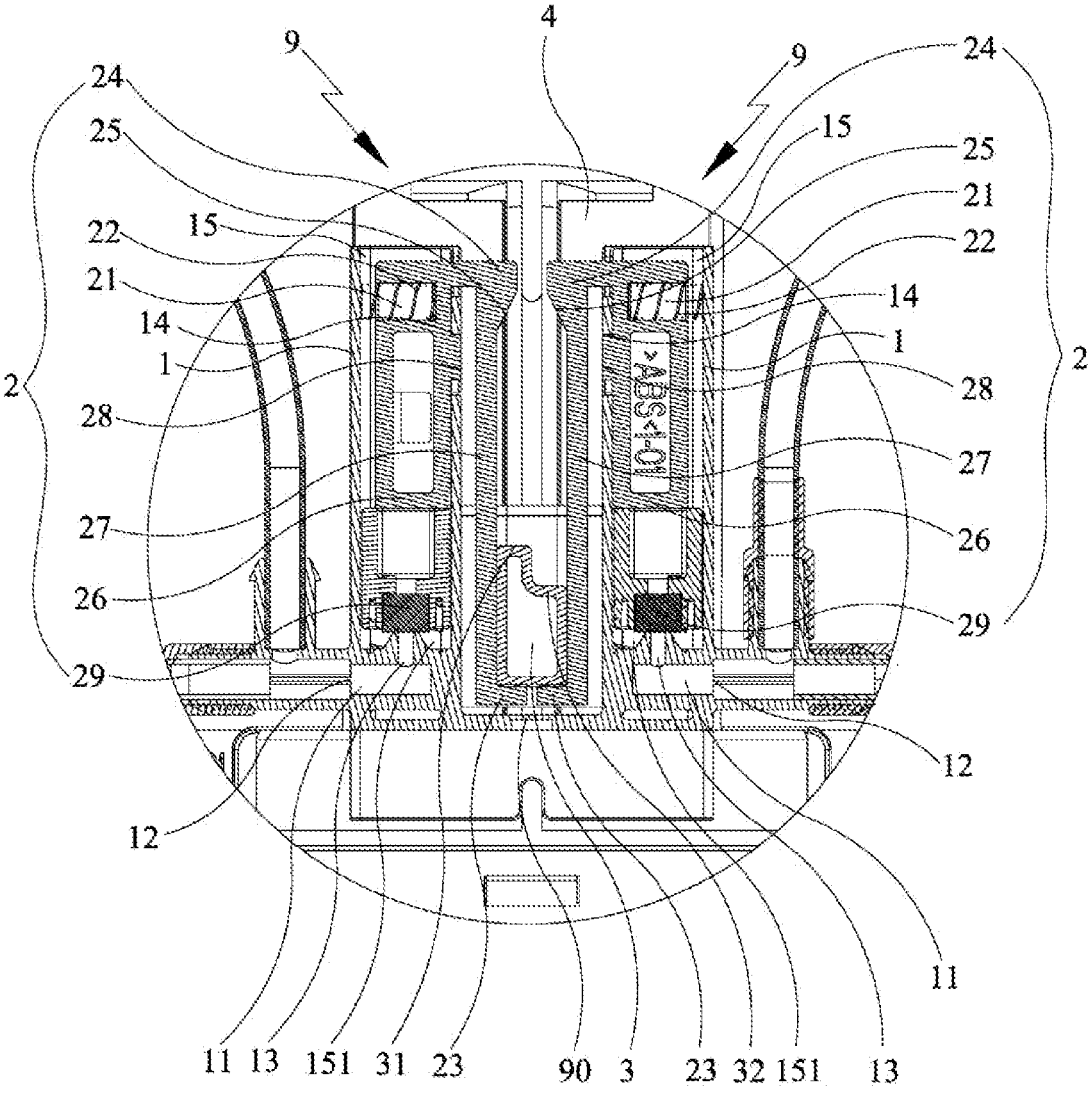
FIG. 3 is an enlarged sectional view of part A of the air release valve in FIG. 2.

As shown in FIG. 1 to FIG. 3, an air release valve 9 is provided, which includes a valve seat 1, a sliding block 2 and a push block 3. The valve seat 1 is arranged at the upper part of the drain valve body 5 through a mounting seat 90. The bottom of the valve seat 1 is provided with an air release channel 11, one end of the air release channel 11 is an air inlet 12, and the other end of the air release channel 11 forms an air release nozzle 13. The sliding block 2 is located above the air release nozzle 13 and is slidably arranged on the valve seat 1, and a bottom of the sliding block 2 is provided with a sealing gasket 29 for sealing the air release nozzle 13, wherein the sealing gasket 29 is a rubber gasket. A elastic element 22 that is compressed is arranged between the side of the sliding block away from the inner core tube 4 of the drain valve 7 and the valve seat 1. A limit bump 28 is arranged at the side of the sliding block 2 close to the inner core tube 4, and a limit stopper 14 for clamping and limiting the limit bump 28 is arranged at the valve seat 1. An upper stopper 24 and a lower stopper 23 are arranged at the side of the sliding block 2 close to the inner core tube 4, the lower part of the upper stopper 24 is an inclined plane 25, and the push block 3 is arranged between the upper stopper 24 and the lower stopper 23 and is arranged at the upper part of the inner core tube 4.

A cylindrical cavity 15 is formed on the valve seat 1, the air release channel 11 is arranged at the bottom 151 of the cylindrical cavity 15, the air inlet 12 is communicated to the outer side of the bottom 151 of the cylindrical cavity 15, and the air release nozzle 13 is communicated to the inside of the cylindrical cavity 15. The sliding block 2 includes a column rod 26 and a press rod 27, and the column rod 26 and the upper part of the press rod 27 are integrally formed. The column rod 26 is slidably arranged in the cylindrical cavity 15, and the sealing gasket 29 is arranged at the bottom of the column rod 26. The compressed elastic element 22 is arranged on the upper part of the column rod 26 and located between the side far away from the inner core tube 4 and the cylindrical cavity 15. The limit bump 28 is arranged on the side of the column rod 26 close to the inner core tube 4. The limit stopper 14 is a limit hole, and the limit hole is correspondingly arranged on the side wall of the cylindrical cavity 15. The press rod 27 is arranged outside the cylindrical cavity 15 and near the side of the inner core tube 4, and the upper stopper 24 and the lower stopper 23 are respectively arranged on the upper and the bottom of the press rod 26. The upper stopper 24 is a wedge-shaped block at the upper part of the press rod 26, and the lower stopper 23 is an L-shaped transverse hook at the bottom of the press rod 26.

The elastic element 22 is a spring, the upper part of the column rod 26 is provided with a transverse blind hole 21, the spring is placed in the transverse blind hole 21, and one end of the spring extends out of the transverse blind hole 21 and butts against the side wall of the cylindrical cavity 15 of the valve seat 1.

The working principle of the air release valve of the disclosure is as follows: As shown in FIG. 1 to FIG. 3, when the drain valve is closed to stop drainage, the inner core tube 4 falls to drive the water sealing piece 42 to seal the water outlet 51 of the drain valve 7, the lower stopper 23 is pressed by the push block 3 (as shown in FIG. 3), the elastic element 22 pushes the limit bump 28 of the sliding block 2 to insert into the limit hole of the limit stopper 14 on the valve seat 1, and the sealing gasket 29 at the bottom of the sliding block 2 blocks the air release nozzle 13, thus sealing the air release nozzle 13. When the drain valve 7 is opened for drainage, the inner core tube 4 rises, the water sealing piece 42 separates from the water outlet of the drain valve 7. When the inner core tube 4 rises to clamp the limit device 6 of the drain valve 7 (as shown in FIG. 4 and FIG. 7), the inclined plane 25 of the lower part of the upper stopper 24 is pushed upward by the push block 3, such that the elastic element 22 is compressed, and the sliding block 2 moves upward and laterally shifts on the valve seat 1, the limit bump 28 of the sliding block 2 exits the limit stopper 14 on the valve seat 1, and the sealing gasket 29 at the bottom of the sliding block 2 separates from the air release nozzle 13, so as to open the air release nozzle 13 for air release.

As shown in FIG. 1 to FIG. 9, An air pressure driven toilet water tank drain valve 7 is provided, which includes a drain valve body 5, an inner core tube 4, a limit device 6, a telescopic airbag 8, an air pump (not shown), the air release valve 9, a controller (not shown), and an electronic inductive switch (not shown), wherein the air pump and the electronic inductive switch are electrically connected with the controller. The limit device 6 includes a half drainage limit device 61 and a full drainage limit device 62, wherein the half drainage limit device 61 and the full drainage limit device 62 are arranged in the drain valve body 5. The inner core tube 4 passes through the drain valve body 5, the middle of the inner core tube 4 is clamped with the half drainage limit device 61 and the full drainage limit device 62 respectively. The bottom of the inner core tube 4 is provided with a water sealing piece 42 to block the water outlet 51 at the bottom of the drain valve body 5. The upper part of the inner core tube 4 extends out of the drain valve body 5 and is provided with a lifting cover 43, wherein the lifting cover 43 includes a half drainage lifting cover 431 and a full drainage lifting cover 432, and the half drainage lifting cover 431 and the full drainage lifting cover 432 are symmetrically arranged on the left side and the right side of the upper end of the inner core tube 4. In order to adapt to the half drainage and the full drainage of the dual drain valve, the telescopic airbags shall be used independently, the left and right telescopic airbags 8 are respectively located under the half drainage lifting cover 431 and the full drainage lifting cover 432 and fixed on the drain valve body 5. the left telescopic airbag 8 for the half drainage is connected with a half drainage air pipe 80 of the air pump through an air pipe 81, and the right telescopic airbag 8 for the full drainage is connected with a full drainage air pipe 89 of the air pump. In order to adapt to the half drainage and the full drainage of the dual drain valve, air release valves shall be used independently, the valve seats 1 of the left and the right air release valves 9 are set on the mounting seat 90 at the same time, separated from each other and arranged in a mirror setting with the inner core tube 4 as an axis. Such that the upper stopper 24 and the lower stopper 23 of the left and right air release valves 9 are opposite arranged, as shown in FIG. 3, the push block 3 of the air release valve 9 is divided into a left push part 31 and a right push part 32 on the inner core tube 4 of the drain valve. The position of the left push part 31 is higher than that of the right push part 32, the left push part 31 is located between the upper stopper 24 and the lower stopper 23 of the left air release valve 9, and the right push part 32 is located between the upper stopper 24 and the lower stopper 24 of the right air release valve 9. The air inlet 12 of the air release valve 9 for the left half drainage is connected with the air pipe 81 of the left telescopic airbag 8 for the half drainage and the half drainage air pipe 80 of the air pump, and the air inlet 12 of the air release valve 9 for the right full drainage is connected with the air pipe 81 of the right telescopic airbag 8 for the full drainage and the full drainage air pipe 89 of the air pump.

Figure 4:
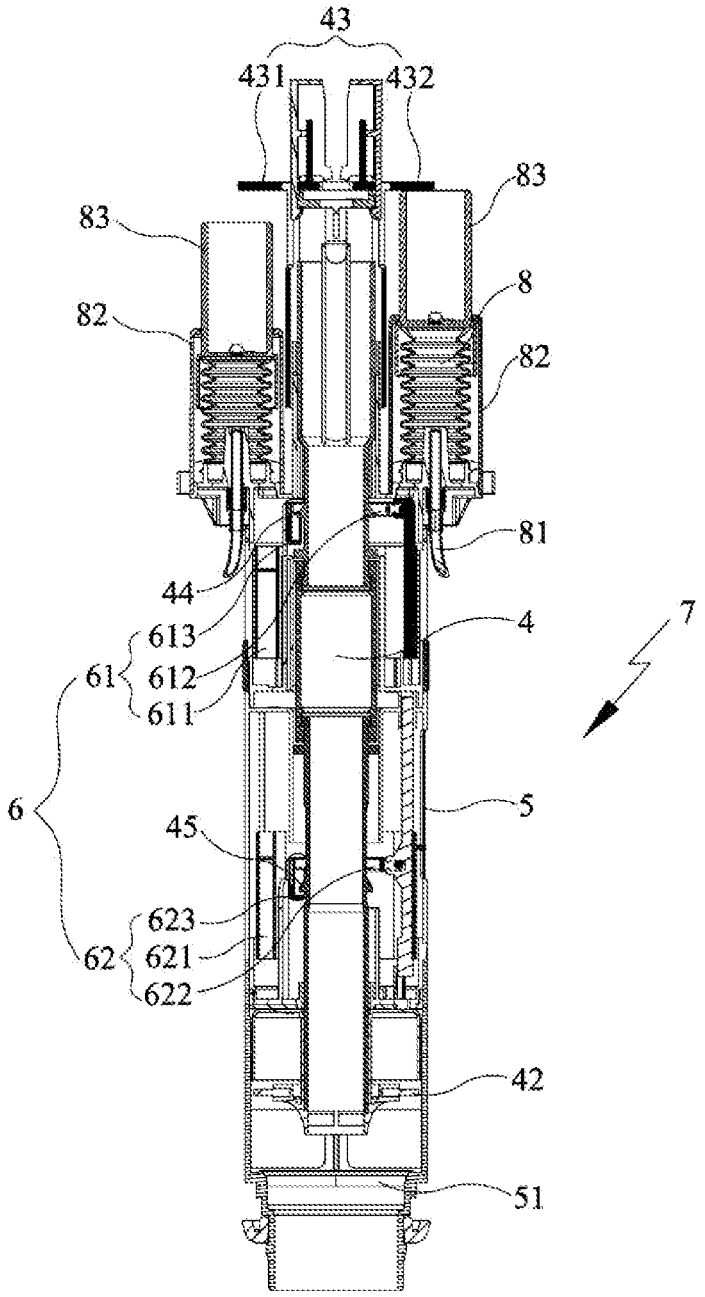
FIG. 4 is a sectional view of the disclosure when the air pressure driven toilet water tank drain valve is in full drainage state.
Figure 7:
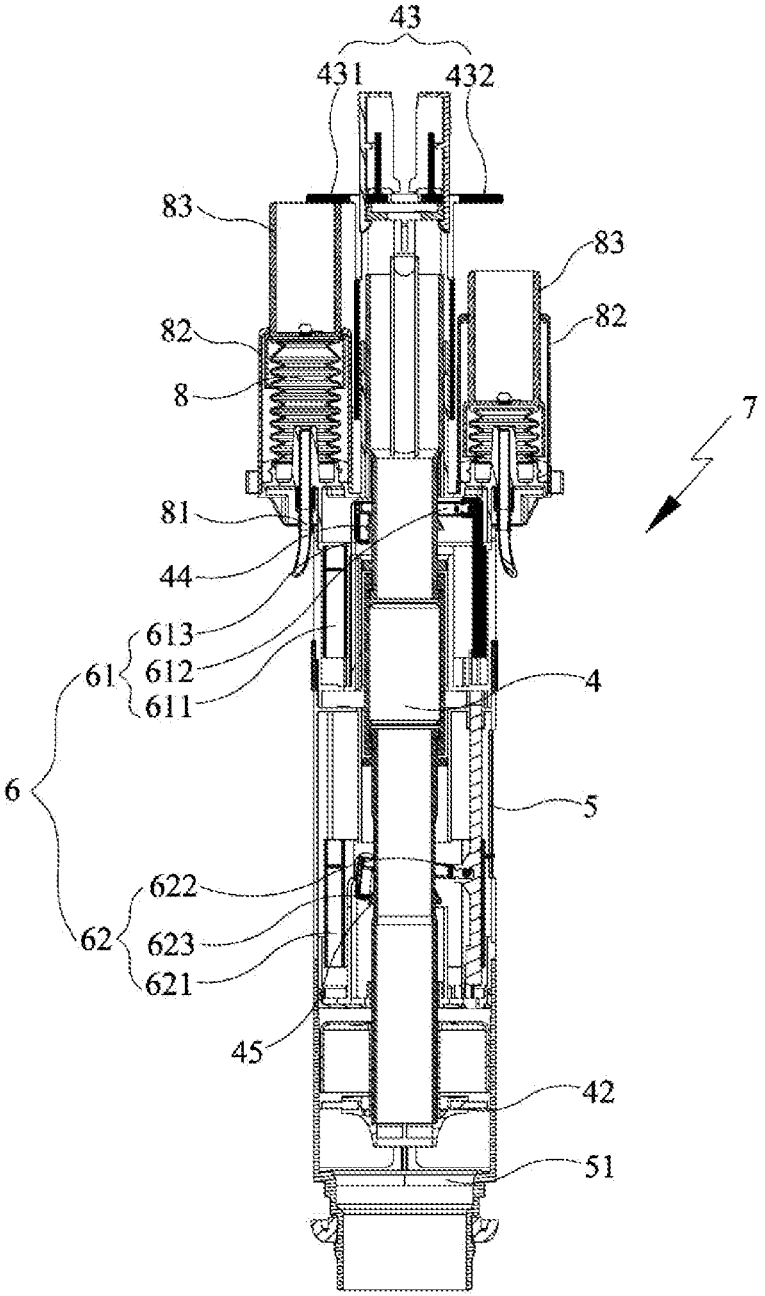
FIG. 7 is a sectional view of the disclosure when the air pressure driven toilet water tank drain valve is in half drainage state.

As shown in FIG. 4 and FIG. 7, the half drainage limit device 61 in the drain valve body 5 is higher than the full drainage limit device 62. The half drainage limit device 61 includes a half drainage floating bucket 611, a half drainage rotating frame 612 and a half drainage hook 613, the half drainage rotating frame 612 is rotatably fixed in the drain valve body 5, the half drainage floating bucket 611 is rotatably arranged on one side of the half drainage rotating frame 612, and the other side of the half drainage rotating frame 612 is provided with the half drainage hook 613. The full drainage limit device 62 includes a full drainage floating bucket 621, a full drainage rotating frame 622 and a full drainage hook 623, the full drainage rotating frame 622 is rotatably fixed in the drain valve body 5, the full drainage floating bucket 621 is rotatably arranged on one side of the full drainage rotating frame 622, and the other side of the full drainage rotating frame 622 is provided with the full drainage hook 623. The inner core tube 4 passes through central holes of the half drainage rotating frame 612 and the full drainage rotating frame 622 respectively. The half drainage hook 613 is clamped with a half drainage clamping point 44 in the middle of the inner core tube 4, and the full drainage hook 623 is clamped with a full drainage clamping point 45 in the middle of the inner core tube 4.

As shown in FIG. 1, FIG. 4 and FIG. 7, the telescopic airbag 8 is arranged in a cylinder body 82, and the cylinder body 82 is located below the lifting cover 43 of the inner core tube 4 and is placed on the drain valve body 5. A piston push rod 83 is slidably provided inside the cylinder body 82, the lower end of the piston push rod 83 is connected with the telescopic airbag 8, and the upper end of the piston push rod 83 extends out of the cylinder body 82 to push the lifting cover 43 of the inner core tube 4.

Figure 8:
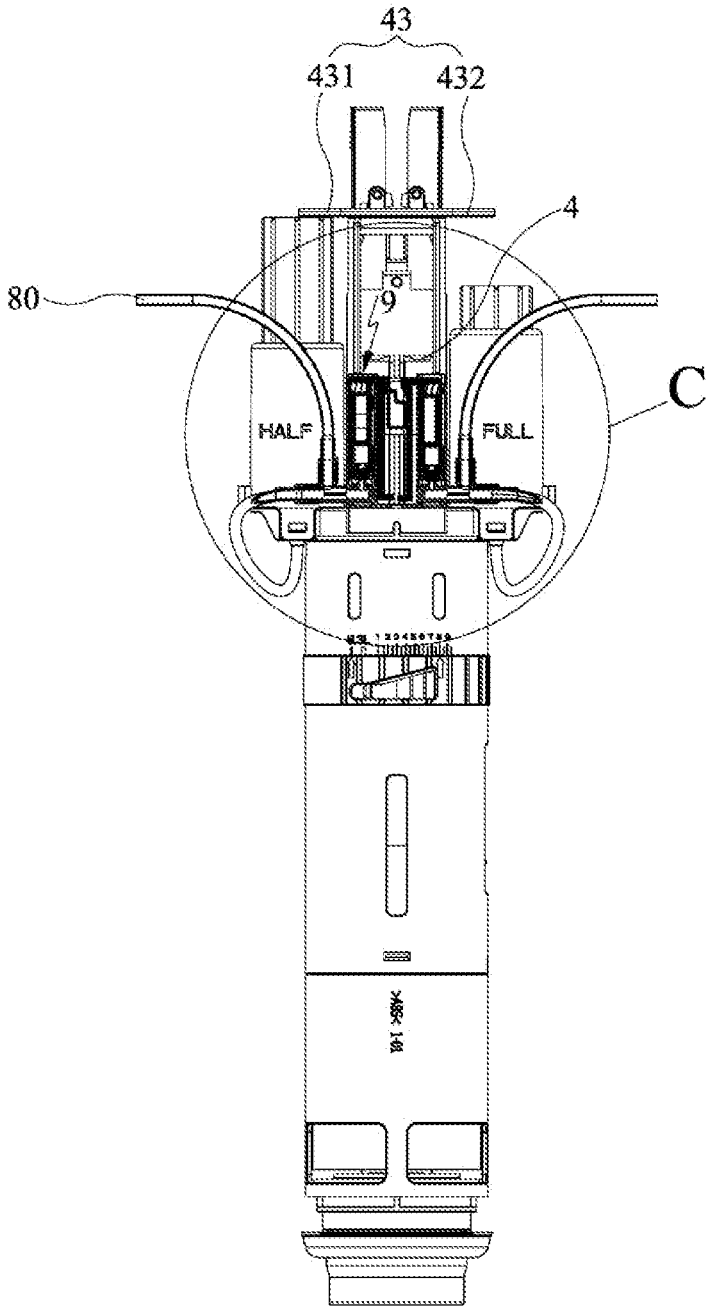
FIG. 8 is a sectional view of the air release valve when the air pressure driven toilet water tank drain valve of the disclosure.
Figure 9:
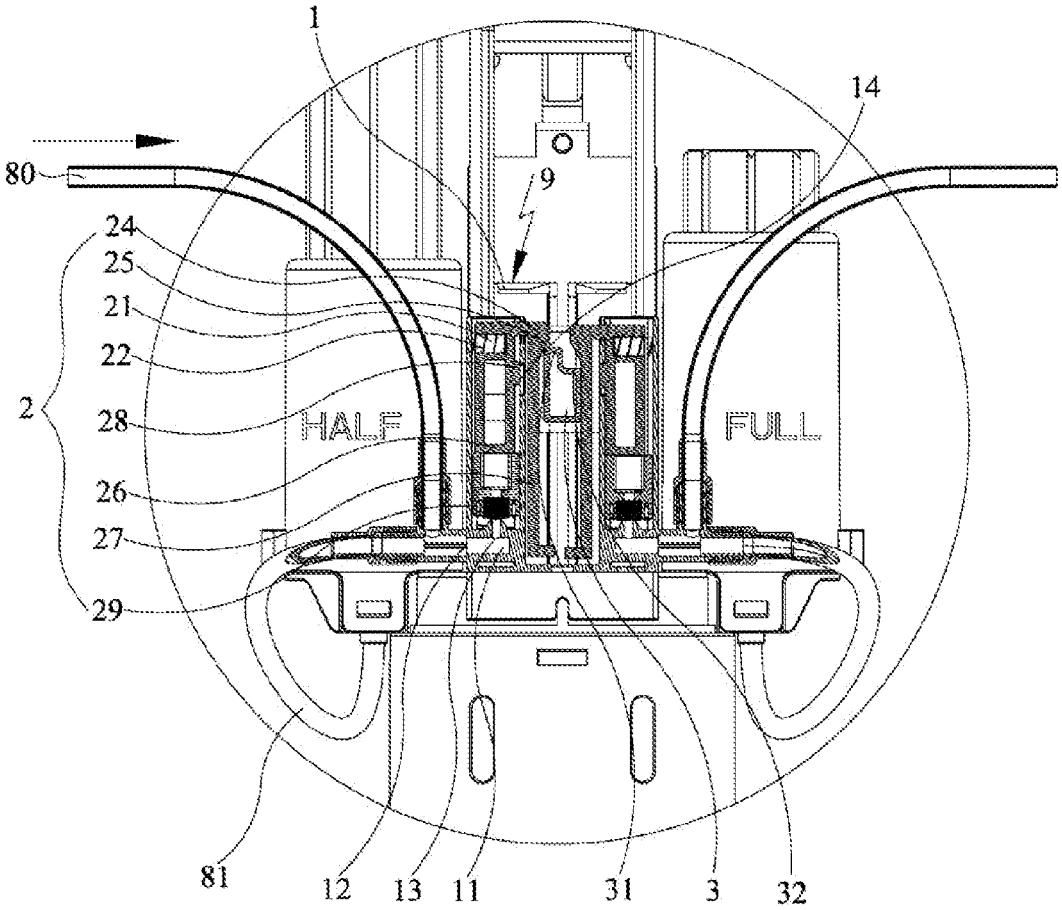
FIG. 9 is an enlarged sectional view of part C of the air release valve in FIG. 8 during half drainage.

As shown in FIG. 4 to FIG. 9, the working principle of the air pressure driven toilet water tank drain valve of the disclosure is that when the drain valve 7 needs to be opened for drainage, the electronic induction switch (not shown) senses the motion of the people such as people wave their hands above the electronic induction switch, the number or the time of people wave their hands represents that the drain valve is to open the half drainage or the full drainage, as shown in FIG. 7 to FIG. 9, if the electronic induction switch (not shown) senses the instruction of the half drainage, the instruction signal of the half drainage will be sent to the controller (not shown), the controller turns on the air pump (not shown), the air pump inflates the left telescopic airbag 8 for the half drainage through the half drainage air pipe 80, the left telescopic airbag 8 for the half drainage expands and pushes the lifting cover 431 on the inner core tube 4 of the drain valve, so as to drive the inner core tube 4 to rise, and the water sealing piece 42 separates from the water outlet 51 of the drain valve 7, so as to open the half drainage function of the drain valve. Since the position of the half limit device 61 is higher than that of the full limit device 62, the half drainage clamping point 44 in the middle of the inner core tube 4 is clamped with the half drainage hook 613 firstly, at this time, the full drainage clamping point 45 in the middle of the inner core tube 4 dose not raise to the position of the full drainage hook 623 (as shown in FIG. 7), such that the full drainage hook 623 cannot play a clamp limit function to the full drainage clamping point 45. When the half drainage clamping point 44 in the middle of the inner core tube 4 is clamped with the half drainage hook 613 of the half drainage limit device 61, because the position of the left push part 31 is higher than that of the right push part 32 in the push block 3, the left push part 31 firstly contacts the inclined plane 25 of the lower part of the upper stopper 24 of the left air release valve 9, the push block 3 pushes against the inclined plane 25 of the lower part of the upper stopper 24. The elastic element 21 is compressed, the sliding block 2 moves upward and laterally shafts on the valve seat 1 of the air release valve 9, the limit bump 28 of the sliding block 2 exits the limit stopper 14 on the valve seat 1, and the sealing gasket 29 at the bottom of the sliding block 2 separates from the air release nozzle 13, so as to open the air release nozzle 13 for air release. the left telescopic airbag 8 for the half drainage conducts air release through the air pipe 81 and the air release nozzle 13, the left telescopic airbag 8 for the half drainage uses its own elastic retraction to restore the original state, giving way to the falling of the inner core tube 4. After the half drainage is completed, the half drainage floating bucket 611 of the half drainage limit device 61 loses its buoyancy and falls, driving the half drainage rotating frame 612 to rotate, and the half drainage hook 613 disengages from the clamping of the half drainage clamping point 44 in the middle of the inner core tube 4. When the inner core tube 4 falls and drives the water sealing piece 42 to reseal the water outlet 51 of the drain valve, the lower stopper 23 is pressed by the push block 3 (as shown in FIG. 3), the elastic element 21 pushes against the limit bump 28 of the sliding block 2 to insert into the limit stopper 14 on the valve seat 1, the sealing gasket 29 at the bottom of the sliding block 2 blocks the air release nozzle 13, so as to seal the air release nozzle 13, and a closed air path is formed between the air pump and the left telescopic airbag 8 for the half drainage to prepare for the next drainage opening.

Figure 5:
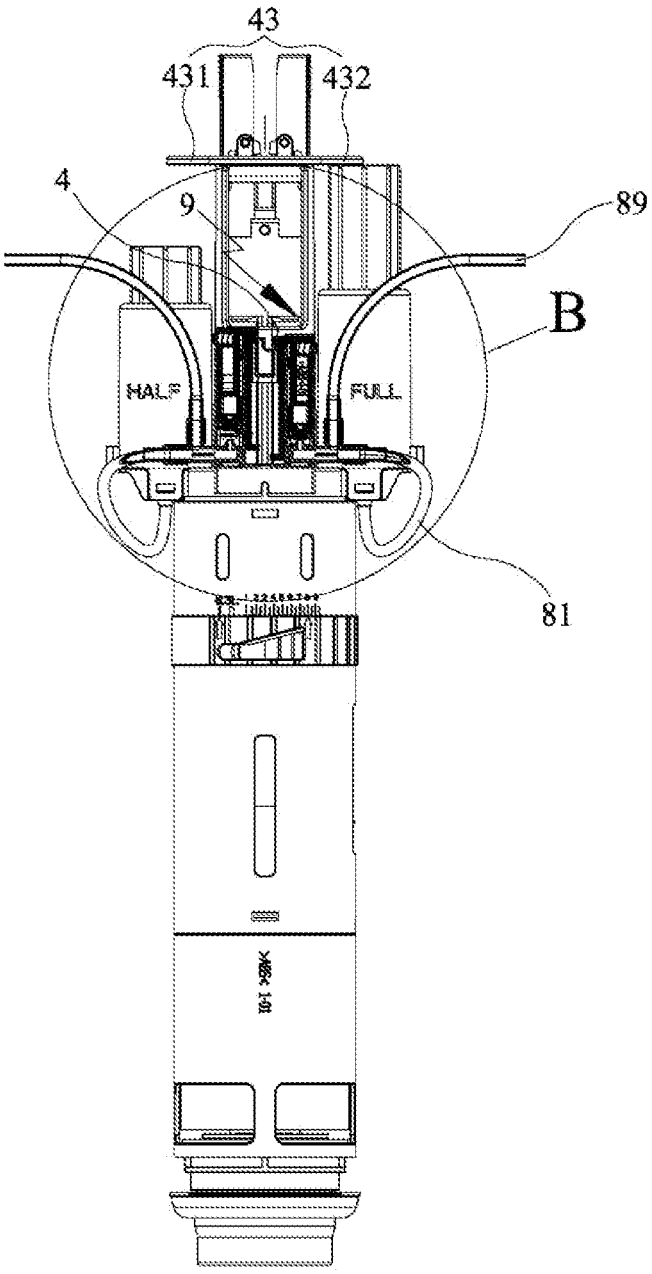
FIG. 5 is a sectional view of the air release valve when the air pressure driven toilet water tank drain valve is in full drainage state.
Figure 6:
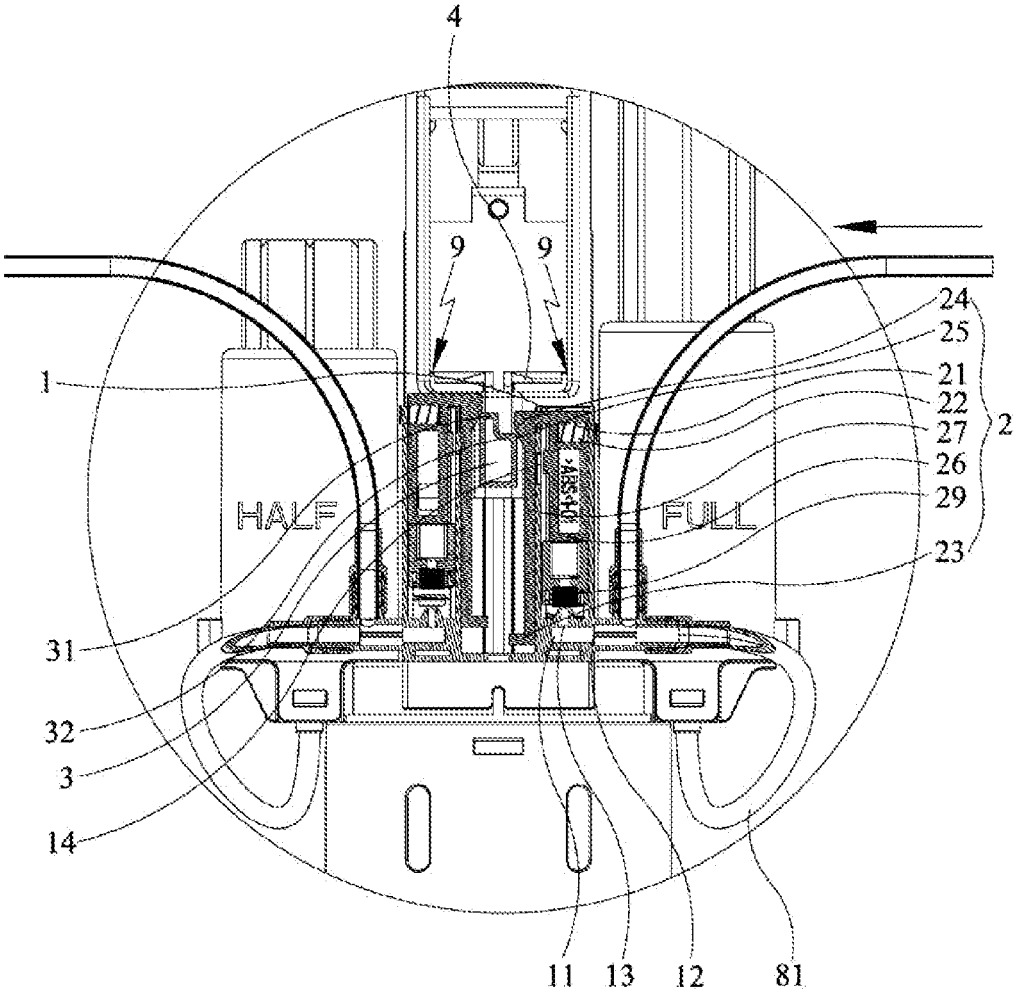
FIG. 6 is an enlarged sectional view of part B of the air release valve in FIG. 5 during full drainage.

Similarly, as shown in FIG. 4, FIG. 5 and FIG. 6, the working principle of the air pressure driven toilet water tank drain valve of the disclosure is that when the electronic induction switch (not shown) senses the instruction of the full drainage, the instruction signal of the full drainage will be sent to the controller (not shown), the controller turns on the air pump (not shown), the air pump inflates the right telescopic airbag 8 for the full drainage through the full drainage air pipe 89, the right telescopic airbag 8 for the full drainage expands and pushes the lifting cover 432 at the right side of the inner core tube 4 of the drain valve, so as to drive the inner core tube 4 to rise, and the water sealing piece 42 separates from the water outlet 51 of the drain valve, so as to open the full drainage function of the drain valve. Since the position of the half limit device 61 is higher than that of the full limit device 62, the full drainage clamping point 45 in the middle of the inner core tube 4 raise to the position of the full drainage hook 623, at this time, the half drainage clamping point 44 is over the position of the half drainage hook 613, such that the half drainage hook 613 cannot play a clamp limit function to the half drainage clamping point 44. When the full drainage clamping point 45 in the middle of the inner core tube 4 is clamped with the full drainage hook 623 of the full drainage limit device 62, because the position of the left push part 31 is higher than that of the right push part 32 in the push block 3, the left push part 31 firstly contacts the inclined plane 25 of the lower part of the upper stopper 24 of the left air release valve 9, the push block 3 pushes against the inclined plane 25 of the lower part of the upper stopper 24. The elastic element 21 is compressed, the sliding block 2 moves upward and laterally shafts on the valve seat 1 of the air release valve 9, the limit bump 28 of the sliding block 2 exits the limit stopper 14 on the valve seat 1, and the sealing gasket 29 at the bottom of the sliding block 2 separates from the air release nozzle 13, so as to open the air release nozzle 13. Since the left telescopic airbag 8 for the half drainage is not inflated, the left telescopic airbag 8 for the half drainage does not push the left half drainage lifting cover 431 on the inner core tube 4, and the left telescopic airbag 8 for the half drainage remains in the original state. At this moment, the right push part 32 of the push block 3 pushes against the inclined plane 25 of the lower part of the upper stopper 24 of the air release valve 9 for the right full drainage. The elastic element 21 is compressed, the sliding block 2 moves upward and laterally shafts on the valve seat 1, the limit bump 28 of the sliding block 2 exits the limit stopper 14 on the valve seat 1, and the sealing gasket 29 at the bottom of the sliding block 2 separates from the air release nozzle 13, so as to open the air release nozzle 13. the right telescopic airbag 8 for the full drainage conducts air release through the air pipe 81 and the air release nozzle 13, the right telescopic airbag 8 for the full drainage uses its own elastic retraction to restore the original state, giving way to the falling of the inner core tube 4. After the full drainage is completed, the full drainage floating bucket 621 of the full drainage limit device 62 loses its buoyancy and falls, driving the full drainage rotating frame 622 to rotate, and the full drainage hook 623 disengages from the clamping of the full drainage clamping point 45 in the middle of the inner core tube 4. When the inner core tube 4 falls and drives the water sealing piece 42 to reseal the water outlet 51 of the drain valve, the lower stopper 23 is pressed by the push block 3, the elastic element 21 pushes against the limit bump 28 of the sliding block 2 to insert into the limit hole of the limit stopper 14 on the valve seat 1, the sealing gasket 29 at the bottom of the sliding block 2 blocks the air release nozzle 13, so as to seal the air release nozzle 13, and a closed air path is formed between the air pump and the right telescopic airbag 8 for the full drainage to prepare for the next drainage opening.

The above description is only a preferred embodiment of the disclosure, not a limitation on the design of the present application. Any equivalent substitutions made according to the design keys of the present application shall be fallen within the scope of the present application.

What is claimed is:

1. An air release valve, comprising a valve seat, a sliding block and a push block, wherein the valve seat is arranged at an upper part of the drain valve body through a mounting seat, a bottom of the valve seat is provided with an air release channel, one end of the air release channel is an air inlet, the other end of the air release channel forms an air release nozzle, the sliding block is located above the air release nozzle and is slidably arranged on the valve seat, and a bottom of the sliding block is provided with a sealing gasket for sealing the air release nozzle, a compressed elastic element is arranged between a side of the sliding block away from an inner core tube of the drain valve and the valve seat, a limit bump is arranged at a side of the sliding block close to the inner core tube of the drain valve, a limit stopper for clamping the limit bump is arranged at the valve seat, an upper stopper and a lower stopper are arranged at the side of the sliding block close to the inner core tube of the drain valve, a lower part of the upper stopper is an inclined plane, and the push block is arranged between the upper stopper and the lower stopper and is arranged at an upper part of the inner core tube of the drain valve.

2. The air release valve according to claim 1, wherein a cylindrical cavity is formed on the valve seat, the air release channel is arranged at a bottom of the cylindrical cavity, the air inlet is communicated to an outer side of the bottom of the cylindrical cavity, and the air release nozzle is is communicated to an inside of the cylindrical cavity; the sliding block comprises a column rod and a press rod, the column rod and an upper part of the press rod are integrally formed, the column rod is slidably arranged in the cylindrical cavity, and the sealing gasket is arranged at a bottom of the column rod; the compressed elastic element is arranged on an upper part of the column rod and located between a side far away from the inner core tube of the drain valve and the cylindrical cavity; the limit bump is arranged on a side of the column rod close to the inner core tube of the drain valve, the limit stopper is a limit hole, and the limit hole is correspondingly arranged on a side wall of the cylindrical cavity; the press rod is arranged outside the cylindrical cavity and near the side of the inner core tube of the drain valve, and the upper stopper and the lower stopper are respectively arranged on an upper and a bottom of the press rod.

3. The air release valve according to claim 1, wherein the elastic element is a spring, the upper part of the column rod is provided with a transverse blind hole, the spring is placed in the transverse blind hole, and one end of the spring extends out of the transverse blind hole and butts against the side wall of the cylindrical cavity of the valve seat.

4. The air release valve according to claim 1, wherein the sealing gasket is a rubber gasket.

5. An air pressure driven toilet water tank drain valve, comprising a drain valve body, an inner core tube, a limit device, a telescopic airbag, an air pump, the air release valve of claim 1, a controller, and an electronic inductive switch, wherein the air pump and the electronic inductive switch are electrically connected with the controller; the limit device comprises a half drainage limit device and a full drainage limit device, the half drainage limit device and the full drainage limit device are arranged in the drain valve body, the inner core tube passes through the drain valve body, a middle of the inner core tube is clamped with the half drainage limit device and the full drainage limit device respectively; a bottom of the inner core tube is provided with a water sealing piece to block the water outlet at a bottom of the drain valve body; an upper part of the inner core tube extends out of the drain valve body and is provided with a lifting cover, the lifting cover comprises a half drainage lifting cover and a full drainage lifting cover, and the half drainage lifting cover and the full drainage lifting cover are symmetrically arranged on a left side and a right side of an upper end of the inner core tube; the left and right telescopic airbags are respectively located under the half drainage lifting cover and the full drainage lifting cover and fixed on the drain valve body; the left telescopic airbag for the half drainage is connected with a half drainage air pipe of the air pump through an air pipe, and the right telescopic airbag for the full drainage is connected with a full drainage air pipe of the air pump, the valve seats of the left and the right air release valves are set on the mounting seat at the same time, separated from each other and arranged in a mirror setting with the inner core tube as an axis; the upper stopper and the lower stopper of the left and right air release valves are opposite arranged; the push block of the air release valve is divided into a left push part and a right push part on the inner core tube of the drain valve, the left push part is higher than the right push part, the left push part is located between the upper stopper and the lower stopper of the left air release valve, and the right push part is located between the upper stopper and the lower stopper of the right air release valve; the air inlet of the air release valve for the left half drainage is connected with the air pipe of the left telescopic airbag for the half drainage and the half drainage air pipe of the air pump, and the air inlet of the air release valve for the right full drainage is connected with the air pipe of the right telescopic airbag for the full drainage and the full drainage air pipe of the air pump.

6. The air pressure driven toilet water tank drain valve according to claim 5, wherein the half drainage limit device in the drain valve body is higher than the full drainage limit device, the half drainage limit device comprises a half drainage floating bucket, a half drainage rotating frame and a half drainage hook, the half drainage rotating frame is rotatably fixed in the drain valve body, the half drainage floating bucket is rotatably arranged on one side of the half drainage rotating frame, and the other side of the half drainage rotating frame is provided with the half drainage hook; the full drainage limit device comprises a full drainage floating bucket, a full drainage rotating frame and a full drainage hook, the full drainage rotating frame is rotatably fixed in the drain valve body, the full drainage floating bucket is rotatably arranged on one side of the full drainage rotating frame, and the other side of the full drainage rotating frame is provided with the full drainage hook; the inner core tube passes through central holes of the half drainage rotating frame and the full drainage rotating frame respectively; the half drainage hook is clamped with a half drainage clamping point in the middle of the inner core tube, and the full drainage hook is clamped with a full drainage clamping point in the middle of the inner core tube.

7. The air pressure driven toilet water tank drain valve according to claim 5, wherein the telescopic airbag is arranged in a cylinder body, the cylinder body is located below the lifting cover of the inner core tube and is placed on the drain valve body, a piston push rod is slidably provided inside the cylinder body, a lower end of the piston push rod is connected with the telescopic airbag, and an upper end of the piston push rod extends out of the cylinder body to push the lifting cover of the inner core tube.

* * * * *